United States Patent [19]

LaRosa

[11] Patent Number: 4,962,589

[45] Date of Patent: Oct. 16, 1990

[54] OFFSET SIGHT

[76] Inventor: Michael J. LaRosa, 8003 A General Grant Dr., Fort Drum, N.Y. 13602

[21] Appl. No.: 412,910

[22] Filed: Sep. 26, 1989

[51] Int. Cl.[5] ..... F41G 1/42

[52] U.S. Cl. ..... 33/233; 33/257

[58] Field of Search ..... 33/233, 234, 252, 257, 33/261, 276, 278, 279, 280; 42/100, 101, 102, 103

[56] References Cited

U.S. PATENT DOCUMENTS

| | | |
|---|---|---|
| 2,367,762 | 1/1945 | Eiane . |
| 3,165,836 | 1/1965 | Margado . |
| 3,886,667 | 6/1975 | Rueb . |
| 3,961,423 | 6/1976 | Hrebar . |
| 4,291,473 | 9/1981 | Lough . |
| 4,291,479 | 9/1981 | Lough . |

OTHER PUBLICATIONS

American Rifleman, "Getting Back on Target", Ron Swartley, Dec. 1988, pp. 36–37.

*Primary Examiner*—William A. Cuchlinski, Jr.
*Assistant Examiner*—Alvin Wirthlin
*Attorney, Agent, or Firm*—Wall and Roehrig

[57] ABSTRACT

An offset sighting device has a frame with a clamping section for clamping the device to the upper handle portion of an M16 rifle and includes an adjustably mounted sight bar with adjustments both laterally for offset and vertically for range to calibrate the device when installed on an M16 rifle for accurate targeting of a target at a given range permitting the rifle to be aimed and fired from the offset position when the soldier is wearing chemical protective masks and clothing which make firing a rifle with a conventional sighting means virtually impossible.

8 Claims, 2 Drawing Sheets

OFFSET SIGHT

This is a substitute application for application Ser. No. 07/338,708 filed Mar. 30, 1989 filed in the name of Michael J. LaRosa.

BACKGROUND OF THE INVENTION

This invention relates to a weapon sighting device that is not aligned with the barrel, but mounted off to one side of the weapon barrel and more particularly to a weapon sighting device for use by soldiers wearing chemical protective mask and clothing.

Soldiers armed with the M16 series rifles while wearing their chemical protective mask and clothing, must engage in a series of contortion-like manipulations in order to attempt to sight a target with the standard M16 rifle sights. Current familiarization exercises now require soldiers to be able to engage a target at 25 meters while wearing the chemical protective mask and equipment. The current practice includes cocking the head to one side, tilting the rifle, estimating the impact point of the bullet, and other difficult exercises in order to permit sighting of the rifle while wearing the bulky chemical-protective mask and clothing. Many soldiers completing these exercises are confident in the ability of their chemical-protective equipment to keep them alive, but they develop sincere concerns over their abilities to defend themselves in such an environment.

The present invention involves an offset sighting device that allows one to aim the M16 weapon in a virtually normal position and effectively engage and properly sight targets in excess of 100 meters away. This greatly increases the effective range of the M16 series rifles under chemical protective mask and gear utilization conditions.

OBJECTS AND SUMMARY OF THE INVENTION

It is therefore an object of the present invention to provide an offset sighting device that can be quickly and easily installed on an M16 rifle while wearing chemical protective equipment.

It is another object of the present invention to provide a weapon sighting device for use on M16 series rifles that permits essentially conventional aiming while wearing chemical protective masks and equipment.

It is another object of the present invention to provide an M16 sighting device that can be quickly and easily mounted on the handle of an M16 to permit offset sighting of the weapon at ranges in excess of 100 meters while wearing chemical protective masks and clothing.

It is a still further object of the present invention to provide a weapon sighting device for mounting on the handle of an M16 series rifle that will indicate clearly when it has been stressed out of alignment and should be discarded.

It is a still further object of the present invention to provide a weapon sighting device that can be removed and reinstalled on an M16 series rifle handle without resighting of the device for a particular range.

It is a still further object of the present invention to provide a simple weapon sighting device that can be adapted for either right-hand or left-hand sighting on an M16 series rifle.

These and other and further objects of the present invention, together with additional features and advantages will be apparent from the following description of a preferred embodiment of the invention which is shown in the accompanying drawings wherein:

DETAILED DESCRIPTION OF THE INVENTION

Figure 1:
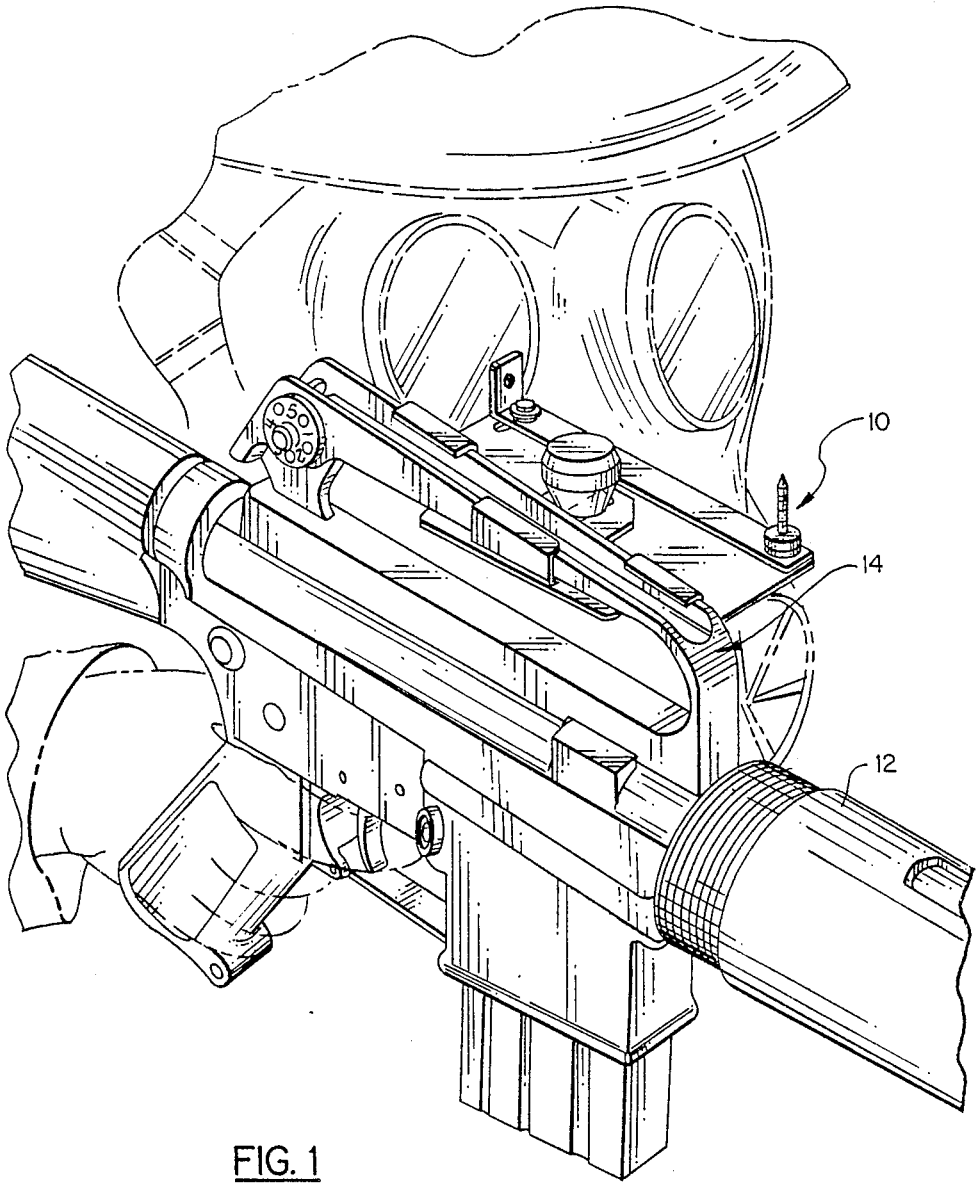
FIG. 1 is a perspective view of the device being used by a soldier wearing a chemical protective mask and clothing.

Referring now to FIG. 1, the offset sighting device 10 of the present invention is shown mounted on an M16 rifle 12 by clamping about the handle portion 14 thereof. As may be seen in FIGS. 1–3, the sighting device comprises basically two sections; one—a base mounting and clamping section 16 and two—a sighting bar section 18, as will be described in detail herein.

The basic mounting section 16 consists of a base plate portion 20 which has two fixed upstanding ears 22 and 24, each with flanges 26 extending outwardly from the plate 20 so as to engage the top of one side of the handle 14 of the M16 rifle. Plate 20 also has mounted thereon adjustable clamping bracket 28 which has a slot 30 through which the knob 32 and its associated screw 34 are inserted to engage plate 20. Clamping bracket 28, together with ears or bracket portions 22 and 24 of plate 20 can be clamped about the handle 14 of the M16 rifle, as may be seen in FIG. 1, by tightening the nut 32 to hold the assembly securely in position on the handle 14. As can be seen, the ears taper from longest at 22 to shortest at 24, matching the taper of the M-16 handle. Obviously, other rifles may require other size and shape clamping means.

The knob 32 is of a large enough size, both in diameter and in vertical height to permit its ready tightening and loosening, by a soldier wearing chemical protective gloves. The surfaces of the clamp portions 22, 24 and bracket 28 are preferably coated with a non-slip material 29 such as rubber or plastic to ensure that once clamped in place on the handle 14 of the rifle 12 that the plate 20 will remain in the desired position.

Figure 3:
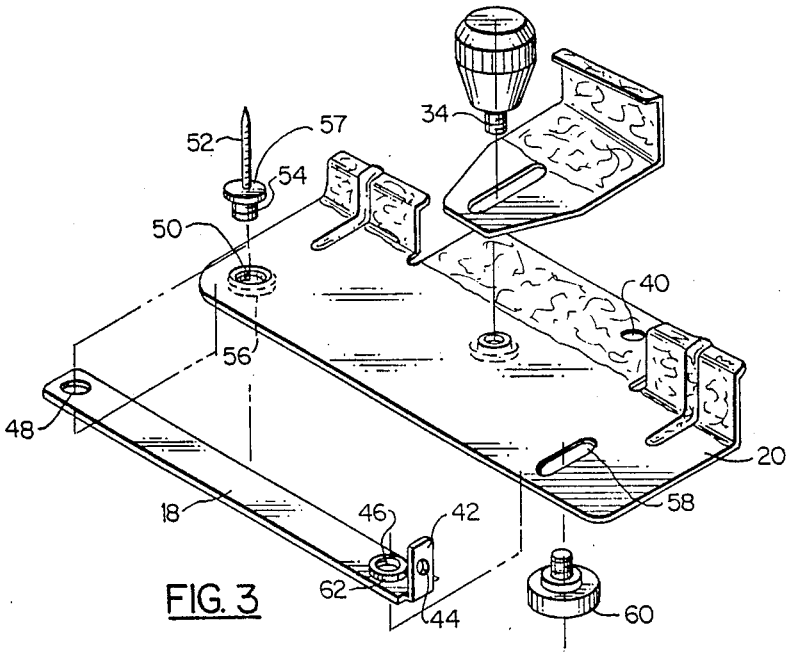
FIG. 3 is an exploded perspective view showing the adjustable features of the present invention.

Also provided in the plate 20, as may be seen in FIG. 3 is a hole 40 which, on mounting on the handle 14, is aligned with a corresponding hole or location mark (not shown) in the handle 14 to indicate proper positioning of the assembly on the rifle. Alignment of hole 40 with the handle 14 thus permits removal and reinstallation without recalibration. Hole 40, while shown adjacent bracket 22, may be positioned under bracket 28 and a corresponding hole provided in bracket 28 to permit the proper alignment.

Figure 4:
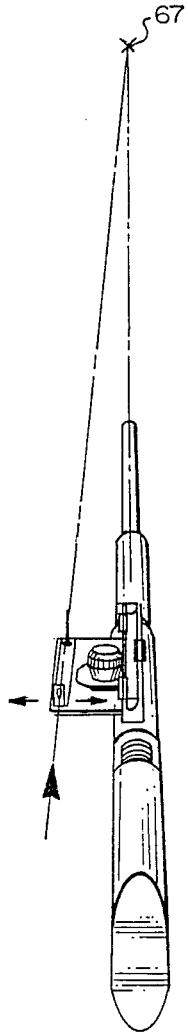
FIG. 4 is a perspective view from breach end of the rifle showing the aiming alignment for a specific target distance.

Again referring to FIGS. 1–3, the sight bar 18 is a generally rectangular L-shaped flat bar having at the up-turned end 42 a peep hole sight 44 which functions as the eye piece of the sighting device, as may be seen perhaps more clearly in FIG. 1. The bar 18 has two holes 46 and 48 drilled therein for mounting and adjustment as will be seen herein. A hole 50 is drilled in the base plate 20 at the target end of the sighting device to correspond with and align with hole 48 when sight bar 18 is mounted on plate 20. Sight pin 52, which functions as the forward sight of the sighting device, has a flanged base with a threaded screw portion 54 which is adapted to project through holes 48 and engage a captive nut 56 mounted in hole 50 for pivotally securing the target end of sight bar 18 to the base plate 20. The other end of sight bar 18 has hole 46, which is positioned to align with a slot 58 in the plate 20 and which is adjustably secured thereto by thumb screw 60 and captive nut 62 mounted in hole 46. The rear end of sight bar 18 can be adjusted side to side by positioning in slot 58 to obtain the desired offset angle for aligning with the target at the known target distance. This may be seen in FIG. 4 wherein the rear end of the sight bar 18 can be adjusted to provide target impact at the desired target 67 from the offset position of bracket 20. This FIG. 4 illustration is, of course, greatly exaggerated in offset of the sighting bar 18, for purposes of clarity of explanation.

In addition to the sight pin 52 pivotally aligning the front end of the sight bar 18, on the plate 20, the pin 52 is threaded at 55 and screwed into a threaded hole in the flange 54 to allow a vertical adjustment of the pin 52 to provide an elevational adjustment in combination with the peep hole sight 44 as is well known in the art. Jamb nut 57 is provided to maintain the desired adjustment.

It should be noted that while individual screws and nuts and bolts have been shown for clarity of explanation, in actual practice, the nuts and/or screws are incorporated into the base plate or various components of the device so that they cannot be easily separated therefrom and lost in field operations. Various types of captured or self-contained nuts and screws, as are common in the art, can be used and need not be described in detail herein.

In use, the sighting device 10 would be pre-calibrated to an individual rifle and soldier for right-hand or left-hand installation as the case may be. As shown in FIGS. 1 and 4, the device would be clamped onto the handle 14 of the M16 rifle 12 with the hole 40 aligned with the corresponding mark in the handle. The clamping bracket 28 will be adjusted to securely clamp the plate 20 about the handle together with the clamp portions 22 and 24. The rubberized coating 29 on these brackets will ensure that the assembly will stay positioned properly on the handle once tightened and clamped in place.

The sight bar will be adjusted for the desired target distance by loosening the screw 60 and nut 62 and positioning the peep sight 44 to the left or right as necessary to ensure desired target impact. Similarly, the sight pin 52 will be adjusted for elevation for the desired target impact zone and then locked in place. Once these adjustments have been made for a particular individual on a particular target range, the device may then be easily and quickly removed by loosening knob 32 and the assembly can be stored until it is needed for use in exercises or other field uses.

Typically, when a situation calls for donning of chemical protective clothing and masks, the soldier would, as soon as fully clothed to meet the tactical situation, install the sighting device 10 in the precalibrated condition properly on the handle and secure it for operational use. The rifle 12 can then be aimed in virtually the conventional manner without going through the difficulties required to use the standard M16 sighting device.

Figure 2:
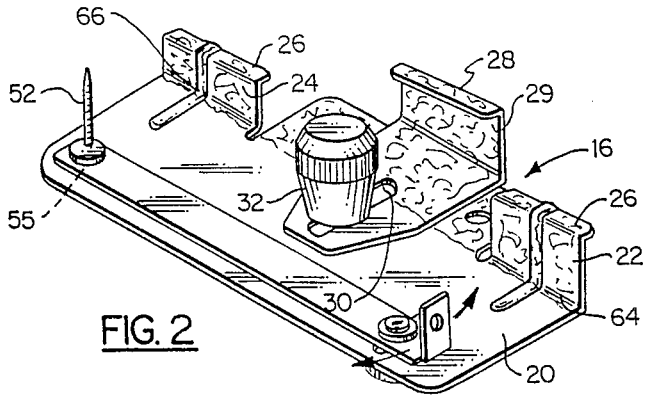
FIG. 2 is a perspective of the device according to the present invention, ready for mounting on rifle.

To install and calibrate the sighting device for the M16 rifle for a left-handed aiming and shooting soldier, the device would be fabricated in mirror imige to that shown in FIGS. 1–3. The device would be clamped and tightened with the same nut 32 and clamping brackets 28 and 22 and 24, but in the reversed position. Thus, the device can be adapted for a left-handed or right-handed soldier so that they can utilize the weapon in their most familiar, comfortable configuration.

Plate 20 is shown with the ears 22 and 24 bent up to form part of the clamp arrangement, together with bracket 28. In actual practice, it is contemplated that the material of plate 20, in which the ears 22 and 24 are an integral part, would be made of a material such that if stressed out of correct alignment, cracks would appear along the lines 64 and 66 alerting the soldier to the fact that the device was no longer aligned to the proper calibration previously arranged and that the sighting device is no longer accurate, as would be expected. Typically, a hard aluminum could be used for the plate 20 and ears 22, 24 or it could be of a plastic that, when its elastic limit is exceeded, cracks or breaks. This will thus alert the soldier that a new sighting device must be obtained to insure proper accuracy.

A further unique advantage of the present device is that the clamping arrangement is arranged such that it does not interfere with the normal sighting system of the M16 rifle so that the soldier can use the offset sight if a mask is being worn, and if not worn, the regular sight can be used, as desired, interchangeably without having to remove the sighting assembly 10.

While this invention has been described in the specification and illustrated in the drawings with reference to a preferred embodiment, it will be understood by those skilled in the art that various changes may be made and equivalents may be substituted for elements of the invention without departing from the scope of the claims.

What is claimed is:

1. In a weapon sighting system an offset sighting device for easy mounting and dismounting on a weapon so that soldiers wearing chemical protective gear may effectively engage targets comprising:

a generally rectangular base plate member;

a pair of spaced apart bracket members disposed at right angles to said plate member along one edge thereof;

an adjustable L-shaped clamping bracket adapted to be mounted on said plate in handle clamping juxtaposition with said pair of bracket members;

an elongated slot in the base of said L-shaped bracket;

an enlarged tightening knob inserted through said slot and threadably engaging in said base member to selectively fix said adjustable clamping bracket to said base member;

a sight bar adapted to be pivotally mounted on said base plate member said sight bar being laterally displaced from a barrel of the weapon upon said base plate, and having at one end an L-shaped vertical portion;

a sight peep hole in the vertical portion of said bar and a mounting hole adjacent the other end;

a threaded sight pin adapted to be inserted through said sight bar mounting hole to adjustably engage a portion of said base member so as to vertically position said sight pin for a desired elevation and to pivotally mount one end of said sight bar to said base member;

a second hole in said sight bar adjacent said vertical portion;

an elongated adjusting slot in an offset portion of said base member offset from the barrel of said weapon, positioned in operative alignment with said second hole in said sight bar;

screw means for selectively fixing the sight bar in said adjusting slot in said base member at a desired offset;

whereby the sighting system of the weapon may be offset from regular sights sufficiently to allow target sighting and acquisition while wearing chemical protective clothing.

2. A device as described in claim 1 wherein the clamping bracket is coated with friction-enhancing material to ensure retention of the device in the clamped position about the weapon.

3. A device as described in claim 1 wherein said spaced apart bracket members include means clearly indicating misalignment of the sighting device when the elastic limit of the material from which it is made has been exceeded.

4. A device as described in claim 1 wherein said base member includes an alignment hole for sighting an alignment mark in the handle of an M16 rifle so that said sighting device can be repeatedly installed on the handle of an M16 rifle in a fully aligned condition without recalibration.

5. A device as described in claim 1 further defined by said tightening knob and said threaded sight pin being of the captive type operatively affixed to said offset sighting device so that they will not be lost in field installation and removal of said device.

6. A device as described in claim 1 wherein said offset sighting device may be installed in one position for right hand firing of the weapon and in a reverse position for left hand firing of the weapon.

7. A device as described in claim 1 further defined by said spaced apart and adjustable bracket members having L-shaped flange portions at their upper edge to further engage about and clamp to the handle of the weapon.

8. In a weapon sighting system an offset sighting device for easy mounting and dismounting on a weapon so that soldiers wearing chemical protective gear may effectively engage targets comprising:

a generally rectangular base plate member;

at least one clamping bracket member extending upwardly from said plate member along one edge thereof;

an adjustable clamping bracket member adapted to be mounted on said plate in handle clamping juxtaposition with said at least one clamping bracket member;

a sight bar adapted to be pivotally mounted on said base plate member said sight bar being laterally displaced from a barrel of the weapon and having at each end a vertical sighting member;

adjusting slot and screw means in said base member offset from the barrel of said weapon, positioned in operative alignment with said sight bar;

whereby the sighting system of the weapon may be offset from regular sights sufficiently to allow target sighting and acquisition while wearing chemical protective clothing.

* * * * *